United States Patent [19]

Piazza

[11] 4,315,391

[45] Feb. 16, 1982

[54] COMPOSITE WALL STRUCTURE AND PROCESS THEREFOR

[75] Inventor: Matthew R. Piazza, Nichols, Conn.

[73] Assignee: Maso-Therm Corporation, Hamden, Conn.

[21] Appl. No.: 677,479

[22] Filed: Apr. 15, 1976

Related U.S. Application Data

[63] Continuation of Ser. No. 464,724, Apr. 26, 1974, abandoned.

[51] Int. Cl.[3] ..... E02D 27/00; E04B 1/62; E04B 2/14

[52] U.S. Cl. ..... 52/293; 52/309.5; 52/309.12; 52/743

[58] Field of Search ..... 52/447, 439, 309.4, 52/309.5, 309.12, 604, 605, 606, 743, 747; 264/46.2, 45.6, 46.3, 46.4, 46.5, 261, 263

[56] References Cited

U.S. PATENT DOCUMENTS

| | | | |
|---|---|---|---|
| 2,748,593 | 6/1956 | Stetter | 52/447 |
| 3,298,883 | 1/1967 | Lemelson | 52/743 |
| 3,306,000 | 2/1967 | Barnes | 52/747 |
| 3,629,384 | 12/1971 | Elegenstierna | 264/45.8 |
| 3,715,417 | 2/1973 | Pope | 264/261 |

OTHER PUBLICATIONS

American Builder, Mar. 1962, p. 125.
Construction Methods, Jun. 1948, p. 96.

*Primary Examiner*—John E. Murtagh

*Attorney, Agent, or Firm*—Sprung, Felfe, Horn, Lynch & Kramer

[57] ABSTRACT

A composite wall structure is disclosed and includes a plurality of vertically stacked building blocks forming a wall structure without mortar or other binder between contiguous blocks. Distinct, continuous layers of rigid urethane polymer foam cover both exterior sides of the wall, these foam layers being adhesively secured to the sides of the wall and extending into the surface pores of the blocks and into the vertical and horizontal seams formed by the blocks. The resultant composite wall structure can be characterized as being hermetically sealed, monolithic, insulated and having improved lateral strength imparted thereto by the exterior foam layers.

The building blocks forming the wall structure can have vertical cells and in addition to the exterior rigid foam layers, or in place of same, the vertical cells of the building blocks can be substantially filled with rigid urethane polymer foam which is adhesively secured to the walls of the cells and which extends into the surface pores thereof and into the interior vertical and horizontal seams formed by the blocks.

A process is also disclosed which involves vertically stacking a plurality of building blocks, which may have vertical cells, spraying both exterior sides and/or the interior cells with a foamable liquid urethane polymer composition and thereafter allowing the liquid to foam to form distinct exterior layers of rigid urethane polymer foam and/or to substantially fill the interior cells of the building blocks.

7 Claims, 5 Drawing Figures

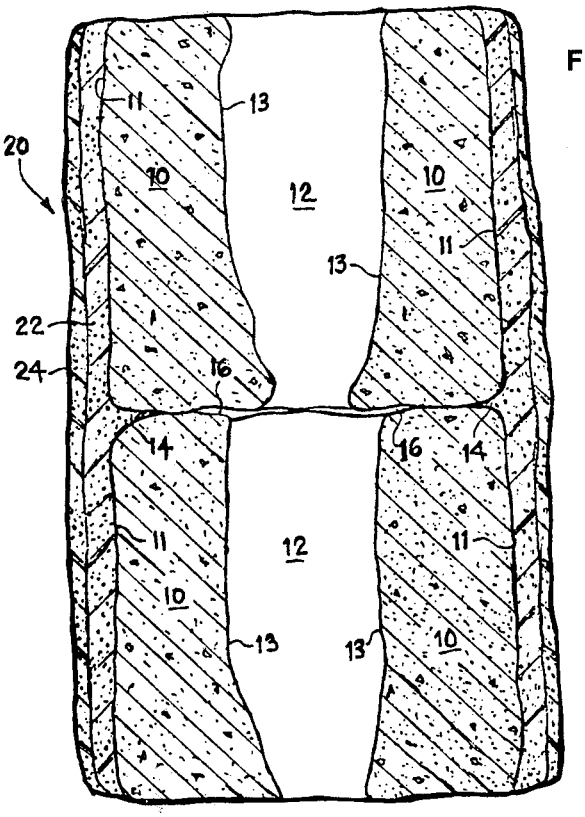
FIGURE 1.
FIGURE 2.
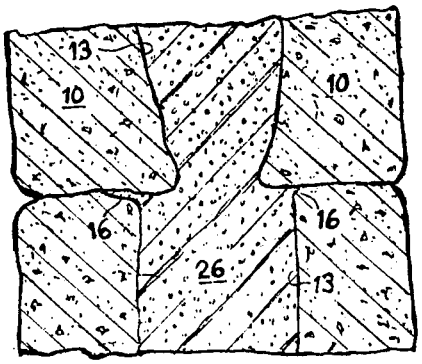
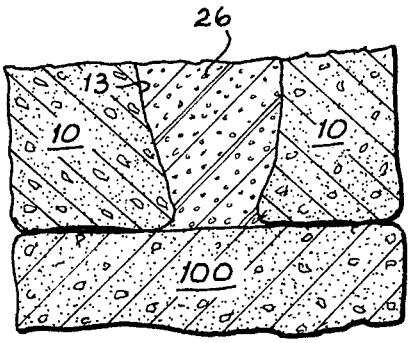
FIGURE 5.

COMPOSITE WALL STRUCTURE AND PROCESS THEREFOR

This is a continuation of application Ser. No. 464,724 filed Apr. 26, 1974 now abandoned.

BACKGROUND

This invention relates to a composite wall structure and a process for erecting such structures. More particularly, this invention relates to a hermetically sealed, monolithic, insulated composite wall having improved lateral strength imparted thereto through the use of rigid urethane polymer foam in combination with otherwise conventional building blocks.

Building blocks, such as cinder block, concrete block, ceramic block, tile and brick, are widely used as a material of construction. Such blocks are conventionally erected into wall and similar structures using mortar or similar binders between individual blocks. This, however, is slow operation requiring the skills of a mason. In addition, the most popular building block, concrete block, is permeable to moisture and is not a good insulator. It is often necessary, therefore, to seal one or both sides of a concrete block wall and/or apply an insulating material thereto.

Many proposals have been advanced for up-grading the properties of building blocks, such as concrete block and to simplify building techniques. For instance, U.S. Pat. No. 3,653,170 issued Apr. 4, 1972 to A. C. Sheckler provides building blocks with foam interiors. These blocks are constructed into a wall using conventional techniques and additional means are provided for bonding the foam between contiguous blocks.

U.S. Pat. No. 3,306,000 issued Feb. 28, 1967 to Barnes and U.S. Pat. No. 3,597,890 issued Aug. 10, 1971 to Hala are representative of proposals made for simplifying building techniques using building blocks. The Barnes patent involves stacking masonry blocks to form a wall without using mortar and then painting one or both external faces, particularly at the joints where the blocks come together, with a molten composition of glass fibers uniformly dispersed in plasticized sulfur. This approach, however, only avoids the use of mortar and a wall constructed in this manner, especially when only coated on one side, still has to be treated to prevent moisture penetration and insulated to prevent thermal and sound penetration. The Hala patent relates to construction units having a porous resin-impregnated fibrous mesh material. Walls made from such construction units have a cementitious material secured to the exterior surface which penetrates the fibrous mesh. This technique requires the use of especially constructed building units and the application of a cementitious coating using conventional techniques.

In contrast, the present invention provides a hermetically sealed, monolithic, insulated composite wall structure having improved lateral strength which can be erected using conventional building blocks, such as concrete block.

SUMMARY

The present invention provides a composite wall structure which in its broadest embodiment involves a conventional block, such as concrete block in combination with rigid urethane polymer foam which in one step, creates a composite wall structure which is hermetically sealed, monolithic, insulated and which has greatly improved lateral strength as compared to walls constructed from conventional building blocks using known techniques.

In particular, the wall structure of the invention comprises a plurality of vertically stacked building blocks forming a wall structure without mortar or other binder between contiguous blocks, said wall structure having distinct, continuous layers of rigid urethane polymer foam covering both exterior sides thereof, said foam layers being adhesively secured to the sides of the wall and extending into the surface pores of the blocks and into the vertical and horizontal seams formed by the blocks. In addition to or in place of the exterior foam layers, building blocks having vertical cells can be employed and the rigid urethane polymer foam can substantially fill the interior vertical cells of the blocks becoming adhesively secured to the walls of the cells and extending into the surface pores thereof and into the interior, vertical and horizontal seams formed by the blocks.

In a preferred embodiment, a first course of blocks having vertical cells is placed on a foundation or footing and is anchored thereto by rigid urethane polymer foam which substantially fills the vertical cells of the first course of blocks, said foam being adhesively secured to the walls of the cells and the foundation and extending into the surface pores of the cells and the foundation and into horizontal seams formed between the blocks and the foundation or footing.

The process of the invention provides a simplified two step procedure for efficiently erecting sealed monolithic insulated composite walls without mortar. According to the process of the invention, building blocks such as concrete block are vertically stacked to form a wall without mortar or other binder between contiguous blocks. The wall is then sprayed on both sides with a foamable liquid urethane polymer composition which is then allowed to foam, thereby forming distinct continuous layers of rigid urethane polymer foam covering both exterior sides of the wall. In addition to spraying the exterior sides or in place of same, building blocks with interior vertical cells can be employed and a foamable liquid urethane polymer composition can be sprayed into the cells directly and upon foaming, the interior vertical cells of the stacked up wall become filled with a rigid urethane polymer foam which is adhesively secured to the walls of the cells and which extends into the surface pores of the cells and into the interior vertical and horizontal seams formed between the blocks.

DESCRIPTION OF THE DRAWING

The present invention will be more fully understood from the following description taken in conjunction with the accompanying drawing wherein:

FIG. 1 is a cross-sectional view showing a portion of a composite wall of the invention wherein two hollow masonry blocks are stacked on each other with rigid urethane polymer foam layers adhesively secured to both exterior surfaces thereof;

FIG. 2 is a cross-sectional view of a portion of an alternate composite wall structure according to the invention showing two hollow masonry blocks vertically stacked on each other with rigid urethane polymer foam filling the hollow space between contiguous blocks;

FIG. 5 is a cross-sectional view of an alternative embodiment wherein a hollow masonry block is adhered to a foundation by rigid polyurethane foam.

DESCRIPTION

Composite walls and the like constructed according to the present invention have several distinct advantages over walls constructed using known building techniques and conventional building blocks. For example, airless spraying of a foamable liquid urethane polymer composition completely covers, penetrates and wets all surfaces and seams of vertically stacked blocks and, because the foaming action is almost instantaneous, the liquid foams in place completely filling all pores and seams penetrated by the sprayed on liquid.

A very important advantage realized by the present invention is the fact that the rigid urethane polymer foam rapidly and in one step imparts both improved lateral strength and insulating properties to a wall made up of vertically stacked building blocks, such as concrete block. The improvement in lateral strength is realized from the rigid nature of the urethane foam plus its thickness. The insulating properties are realized through the cellular construction of the rigid urethane foam which effectively deadens sound transmissions and prevents penetration by heat and/or cold. Continuous layers of rigid urethane polymer foam applied to the exterior surfaces of a wall hermetically seal the wall and create a monolithic structure. Where hollow building blocks, such as concrete block are utilized, the interior cells become entrapped air pockets which add to the insulating effect.

The present invention is especially suited for constructing walls and similar structures using so-called esthetic block having an integral or laminated exterior surface finish. In this instance foamable liquid urethane polymer composition is sprayed into the interior cells of the stacked up esthetic blocks and as soon as foaming is completed, a composite wall is created with the esthetic surface finish preserved and without having to resort to unsightly mortar-filled seams.

It is also possible, according to the present invention, to incorporate conventional frame members into a wall structure, such frame members including window frames, door frames, headers and sills. Upon the application of rigid urethane polymer foam as described herein, these frame members are completely secured in place and require no further caulking or sealing as is presently required if conventional procedures are followed.

Figure 4:
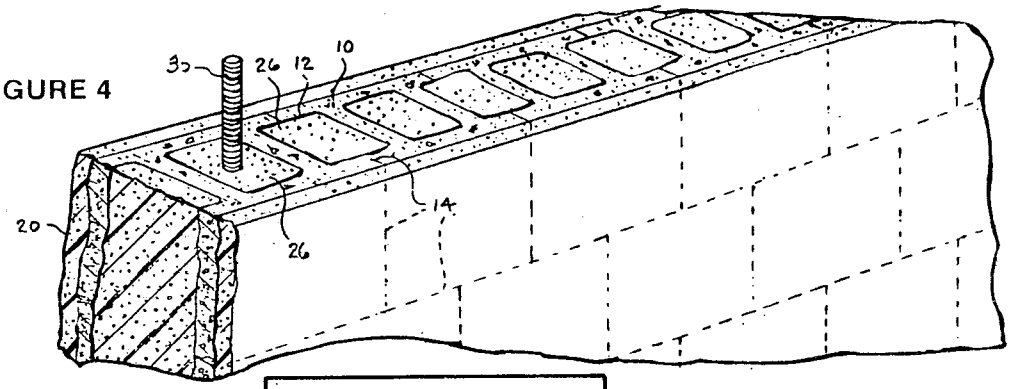
FIG. 4 is a perspective view, partly in cross-section of a preferred composite wall constructed according to the present invention.

Referring now to the drawing, and in particular to FIGS. 1, 2 and 4, the composite wall structure of the invention is shown to include, in a preferred embodiment, a plurality of vertically stacked masonry blocks 10 each having hollow vertical cells 12. The blocks are simply stacked one on top of the other and thereby form vertical and horizontal exterior seams 14 and vertical and horizontal interior seams 16. In the embodiment shown in FIG. 1, continuous layers of rigid urethane polymer foam 20 cover both exterior sides or surfaces 11 of the blocks 10. The rigid foam layer 20 is shown in a preferred embodiment to include two layers 22 and 24 of rigid urethane polymer foam. It is further preferred that the first layer 22 contiguous with the blocks 10 have a density greater than the second or outer layer 24.

The rigid foam layers 20 are adhesively secured to the exterior surfaces 11 of the blocks 10 and the foam actually extends into the surface pores of the blocks and into the vertical and horizontal exterior seams 14 formed between adjacent blocks.

In the embodiment shown in FIG. 2, the vertical cells 12 of the blocks 10 are substantially filled with a rigid urethane polymer foam 26 which is adhesively secured to the walls 13 of the cells 12 extending into the surface pores of the walls 13 and into the interior, vertical and horizontal seams 16 formed by adjacent blocks 10.

The embodiment shown in FIG. 4 is a highly preferred embodiment incorporating the exterior rigid foam layer of FIG. 1 and the interior embodiment shown in FIG. 2 of the drawing. FIG. 4 also illustrates that conventional anchoring devices such as anchoring bolt 30 can be readily incorporated into the unique composite wall structure of the invention.

Figure 3:
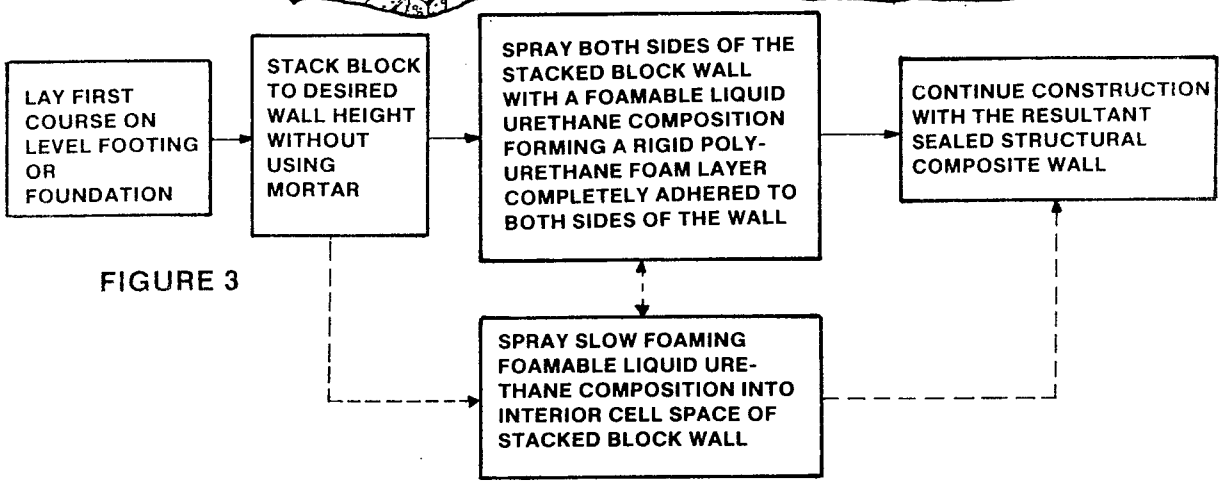
FIG. 3 is a flow diagram illustrating several embodiments of the process of the invention.

FIG. 3 of the drawing schematically illustrates several ways in which the process of the invention can be carried out for erecting composite walls according to the invention. Generally, the first course of masonry block is laid on a level concrete footing or foundation. The blocks can be anchored to the foundation by setting the blocks in a bed of mortar. However, in a preferred embodiment, as shown in FIG. 5, it is preferred to simply place the first course of blocks directly on the foundation 100 and then spray the interior vertical cells of the blocks with foamable liquid urethane polymer composition 26 which is allowed to foam and fill the vertical cells in the first course of blocks. This effectively anchors the first course of block to the foundation. Care should be taken to insure that the first course of block is level and after anchoring to the foundation as described previously the further courses of block are laid up with the blocks tightly butted. If necessary, the joints between courses can be shimed to maintain level and plumness. Sand, sheet metal mortar or the like can be used for shimming if necessary.

With the masonry block wall stacked up, level and plum, foamable liquid urethane polymer composition is sprayed using conventional airless spraying equipment directly onto both exterior sides of the stacked up wall which should preferably be dry before application of the urethane composition. Foaming commences almost instantaneously and is completed within a very short period of time, approximately 15 seconds depending somewhat on the type of urethane composition employed. The density of the rigid foam layers 20 also depends on the nature of the urethane composition employed, but generally ranges between 1.5 pounds per cubic foot to 10 pounds per cubic foot, preferably 2–5 pounds per cubic foot. Where two or more layers are employed to build up the composite layer 20, it is preferred to use a more dense layer for the first layer 22, for example a rigid urethane foam having a density of 5 pounds per cubic foot and a less dense layer 24 for the outer layer, for example a rigid urethane foam having a density of 2 pounds per cubic foot.

When applying or spraying a foamable liquid urethane composition into the interior vertical cells 12 of stacked up masonry block 10, the foaming action of the urethane composition is preferably retarded so as to permit the liquid to flow down into the interior cells of the lower block courses. Foaming then commences substantially filling the interior cells 12 of the blocks 10.

With the composite wall of the invention now complete construction continues in the usual manner. Intersecting walls, roofs and floors and anchoring means are dealt with in the usual fashion.

Because of the greatly improved lateral strength of composite walls constructed according to the invention, additional vertical and/or horizontal reinforcement is not required. Also, because the wall is hermetically sealed further treatment to prevent moisture prnetration is not necessary. Where a wall exterior is exposed to sunlight, it is desirable to apply a UV shield, such as acrylic paint to the surface of the rigid urethane foam.

Foamable urethane compositions forming rigid urethane polymer foams are commercially available in a wide range of chemical and physical properties. Such compositions generally contain an isocyanate component containing reactive isocyanate groups, a polyol component containing one or more polyols, catalytic agents and preferably a flame or fire resistant agent such as trichloromonofluoro methane. Typical properties of rigid urethane polymer foams available commercially are set forth in the following table:

TYPICAL RIGID URETHANE FOAM PROPERTIES

| Density lb./cu. ft. Astm D 1622 | Compressive Strength psi Astm D 1621 | Compressive Modulus psi Astm D 1621 | Shear Strength psi | Shear Modulus psi |
|---|---|---|---|---|
| 1.5-2.0 | 20-60 | 400-2000 | 20-50 | 250-550 |
| 2.1-30 | 35-95 | 800-3500 | 30-70 | 350-800 |
| 3.1-45 | 50-185 | 1500-6000 | 45-125 | 500-1300 |
| 4.6-7.0 | 100-350 | 3800-12,000 | 75-180 | 850-2000 |
| 7.1-10.0 | 200-600 | 5000-20,000 | 125-275 | 1300-3000 |

Preferred foamable urethane compositions are sold under the trademark "ISOFOAM" by Witco Chemical Corporation, New Castle, De.

The present invention can be utilized to advantage in the construction of load bearing exterior and interior walls which are greatly improved in lateral strength and completely insulated. The invention can also be practiced in the manufacture of preformed modules which can then be erected into walls, roofs and the like, for example using the techniques disclosed in the Cook patent, U.S. Pat. No. 3,788,026 issued Jan. 29, 1974.

What is claimed is:

1. Wall structure comprising a plurality of stacked building blocks with direct contact between contiguous blocks each block having one or more vertical cells and forming a stacked wall structure without mortar or other binder or interlocking between contiguous blocks, said stacked blocks being united into said wall structure by substantially filling the vertical cells of said blocks being solely with a material consisting essentially of rigid urethane polymer foam which is adhesively secured to the walls of said cells and which extends into the surface pores thereof and into interior vertical and horizontal seams formed by said stacked blocks, said building blocks and said rigid foam forming a hermetically sealed, monolithic, insulated composite wall structure, the rigid foam in said cells imparting lateral strength to said composite wall.

2. Wall structure of claim 1 wherein the first course of said building blocks rests on a foundation, said first course being anchored to said foundation by rigid urethane polymer foam substantially filling the vertical cells of said first course of building blocks, said foam being adhesively secured to the walls of said cell and said foundation and extending into the surface pores of the walls of said cells and said foundation and into horizontal seams formed between said first course of blocks and said foundation.

3. Process for erecting a wall structure which comprises stacking a plurality of building blocks such that the blocks directly contact each other, each block having one or more vertical cells, forming a stacked wall structure without mortar or other binder or interlocking between contiguous blocks, uniting said stacked blocks into said wall structure by spraying a material consisting essentially of foamable liquid urethane polymer composition into the vertical cells of said vertically stacked blocks thereby substantially filling said cells solely with a rigid urethane polymer foam which is adhesively secured to the walls of said cells and which extends into the surface pores of said cells and into interior, vertical and horizontal seams formed by said blocks, thereby forming a hermetically sealed, monolithic, insulated composite wall structure wherein said rigid foam in said cells imparts lateral strength to said composite wall.

4. Process for erecting a wall structure which comprises stacking a plurality of building blocks each having one or more vertical cells such that the blocks directly contact each other forming a stacked wall without mortar or other binder or interlocking between contiguous blocks, uniting said stacked blocks into said wall structure by (a) spraying a material consisting essentially of foamable liquid urethane polymer composition into said vertical cells and allowing said liquid to foam thereby substantially filling said cells with a rigid urethane polymer foam which is adhesively secured to the walls of said cells and extending into the surface pores thereof and into interior vertical and horizontal seams formed by said blocks, and (b) spraying both exterior sides of said wall with a material consisting essentially of foamable liquid urethane polymer composition, allowing said liquid to foam thereby forming distinct continuous layers of rigid urethane polymer foam covering both exterior sides of said wall, said foam layers being self-adhesively secured to said wall sides and extending into the surface pores thereof and into vertical and horizontal seams formed by said blocks thereby forming a hermetically sealed, monolithic, insulated composite wall structure wherein said foam layers impart lateral strength to said composite wall.

5. Process for erecting a wall structure which comprises placing a first course of building blocks, each having one or more vertical cells on a foundation and spraying a foamable liquid urethane polymer composition into said cells thereby substantially filling said cells with a urethane polymer foam which is adhesively secured to walls of said cells and said foundation, said foam extending into the surface pores of said vertical cells and said foundation and into horizontal seams formed between said blocks and said foundation, vertically stacking a plurality of building blocks on said first course of blocks such that the blocks directly contact each other forming a stacked wall structure without mortar or other binder between contiguous blocks, spraying both exterior sides of said wall with a foamable liquid urethane polymer composition, allowing said liquid to foam thereby forming distinct continuous layers of rigid urethane polymer foam covering both exterior sides of said wall, said foam layers being self-adhesively secured to said wall sides and extending into the surface pores thereof and into vertical and horizontal seams formed by said blocks thereby forming a hermetically sealed, monolithic, insulated, composite wall structure wherein said foam layers impart lateral strength to said composite wall.

6. Wall structure comprising a plurality of stacked building blocks with direct contact between contiguous blocks, each block having one or more vertical cells and forming a stacked wall structure without mortar or other binder or interlocking between contiguous blocks, said stacked blocks being united into said wall structure by (a) distinct, continuous layers of rigid urethane polymer foam covering both exterior sides thereof, said foam layers being self-adhesively secured thereto and extending into surface pores in said blocks and into vertical and horizontal seams formed by said stacked blocks, and (b) substantially filling the vertical cells of said blocks with rigid urethane polymer foam which is adhesively secured to the walls of said cells and which extends into the surface pores thereof and into interior vertical and horizontal seams formed by said stacked blocks, said blocks and said rigid foam forming a hermetically sealed, monolithic, insulated composite wall structure, said foam layers and said foam in said cells imparting lateral strength to said composite wall.

7. Wall structure comprising a plurality of stacked building blocks with direct contact between contiguous blocks forming a stacked wall structure without mortar or other binder or interlocking between contiguous blocks, said stacked blocks being united into said wall structure by distinct, continuous layers of rigid urethane polymer foam covering both exterior sides thereof, said foam layers being self-adhesively secured thereto and extending into surface pores in said blocks and into vertical and horizontal seams formed by said stacked blocks thereby forming hermetically sealed, monolithic, insulated composite wall structure, said foam layers imparting lateral strength to said composite wall, said stacked blocks resting on a foundation, the first course of said blocks each having one or more vertical cells, said first course being anchored to said foundation by rigid urethane polymer foam substantially filling the vertical cells in said first course of blocks, said foam being adhesively secured to the walls of said cells and said foundation and extending into the surface pores of said cells and said foundation and into horizontal seams formed between said blocks and said foundation.

* * * * *